US010679601B2

(12) United States Patent
Linjama et al.

(10) Patent No.: US 10,679,601 B2
(45) Date of Patent: Jun. 9, 2020

(54) ACTIVE CONTROL OF SOUND AND VIBRATION

(71) Applicant: Flexound Systems, Espoo (FI)

(72) Inventors: Jukka Linjama, Espoo (FI); Tommi Immonen, Espoo (FI)

(73) Assignee: FLEXOUND SYSTEMS, Espoo (FI)

( * ) Notice: Subject to any disclaimer, the term of this patent is extended or adjusted under 35 U.S.C. 154(b) by 0 days.

(21) Appl. No.: 16/478,761

(22) PCT Filed: Jan. 15, 2018

(86) PCT No.: PCT/EP2018/050814
§ 371 (c)(1),
(2) Date: Jul. 17, 2019

(87) PCT Pub. No.: WO2018/134142
PCT Pub. Date: Jul. 26, 2018

(65) Prior Publication Data

US 2019/0362702 A1 Nov. 28, 2019

(30) Foreign Application Priority Data

Jan. 17, 2017 (EP) ..... 17151742

(51) Int. Cl.
*G10K 11/178* (2006.01)

(52) U.S. Cl.
CPC .. *G10K 11/17823* (2018.01); *G10K 11/17853* (2018.01); *G10K 2210/129* (2013.01);
(Continued)

(58) Field of Classification Search
CPC .... H04R 1/1083; H04R 5/033; H04R 19/005; H04R 19/04; H04R 1/1008;
(Continued)

(56) References Cited

U.S. PATENT DOCUMENTS 5,133,017 A * 7/1992 Cain ..... G01R 33/3854 381/71.6
6,683,965 B1 * 1/2004 Sapiejewski ..... H04R 1/1083 381/370

(Continued)

FOREIGN PATENT DOCUMENTS

JP H0863174 A 3/1996

OTHER PUBLICATIONS

International Search Report dated Mar. 2, 2018, corresponding to PCT/EP2018/050814 application.

(Continued)

*Primary Examiner* — Lun-See Lao
(74) *Attorney, Agent, or Firm* — Young & Thompson

(57) ABSTRACT

According to an example embodiment, an apparatus for active cancellation of sound and vibration is provided, the apparatus including sound and vibration generation components for jointly producing vibration and sound under control of a driving signal provided as input thereto, the components being arranged inside a padding to generate mechanical vibration that is perceivable as a vibration and sound on at least one outer surface of the padding and to radiate a sound through the at least one outer surface of the padding, a feedback unit for providing feedback information that is indicative of acoustic energy of sound and vibration inside the padding, and a drivert for generating the driving signal in dependence of the feedback information so as to reduce energy of ambient sound and vibration induced inside the padding due to one or more external sources of sound and vibration.

18 Claims, 3 Drawing Sheets

(52) U.S. Cl.
CPC ..... *G10K 2210/3026* (2013.01); *G10K 2210/3044* (2013.01); *G10K 2210/3221* (2013.01); *G10K 2210/501* (2013.01)

(58) Field of Classification Search
CPC ..... H04R 2201/003; H04R 29/004; H04R 2410/05; H04R 2460/11; H04R 2460/13; H04R 3/005; H04R 5/04; H04R 9/06; H04R 1/021; H04R 1/1091; H04R 1/227; H04R 1/2803; H04R 1/2834; H04R 2225/43; H04R 2225/67; H04R 2400/03; H04R 2420/01; H04R 25/305; H04R 25/453; H04R 25/505; H04R 25/606; H04R 3/00; H04R 3/04; H04M 1/0235; H04M 1/0241; H04M 2250/12; H04M 2250/22; H04S 1/005; H04N 21/8358; H04N 13/246; H04N 5/37455; H04N 5/37457; H04N 5/378; G10K 11/178; G10K 2210/1081; G10K 2210/1282; G10K 2210/3026; G10K 2210/3028; G10K 11/17823; G10K 11/17853; G10K 11/1787; G10K 2210/1082; G10K 10/3039; G10K 2210/3219; G10K 2210/501; G10K 11/17813; G10K 11/17835; G10K 11/17854; G10K 11/17855; G10K 2210/129; G10K 2210/3011; G10K 2210/3018; G10K 2210/3025; G10K 2210/3044; G10K 2210/3221; G10K 2210/3226
USPC ..... 381/71.1–71.9, 94.1–94.4, 74, 77
See application file for complete search history.

(56) References Cited

U.S. PATENT DOCUMENTS

| | | | | |
|---|---|---|---|---|
| 9,734,815 | B2 * | 8/2017 | DeFranks | A47G 9/10 |
| 9,905,217 | B2 * | 2/2018 | Hyde | H04R 1/1083 |
| 9,975,459 | B2 * | 5/2018 | Takada | B60R 11/0217 |
| 2013/0129105 | A1 * | 5/2013 | Hua | H04R 1/1083 381/71.6 |
| 2016/0118035 | A1 | 4/2016 | Hyde et al. | |
| 2016/0257227 | A1 | 9/2016 | Takada et al. | |

OTHER PUBLICATIONS

European Search Report dated Jun. 20, 2017, corresponding to PCT/EP2018/050814 application.

* cited by examiner

ACTIVE CONTROL OF SOUND AND VIBRATION

TECHNICAL FIELD

The example embodiments of the present invention relate to enhanced sound perception via vibration.

BACKGROUND

Human auditory perception takes place primarily through the ears, but it is supported by the sense of touch especially at lower end of frequency spectrum. As an example, at frequencies below 50 Hz, sound pressure levels above 80 dB are typically required in order to make a sound perceivable by a human listener. At such sound pressure levels, human skin starts to vibrate at perceivable levels as well, resulting in the sense of touch, i.e. the vibrotactile sense, that server to support hearing. At frequencies below 20 Hz (infrasonic frequencies), hearing or sensing of air pressure vibrations is solely based on vibrotactile perception. In addition to very low frequencies below 20 Hz, the frequency range of vibrotactile perception on skin typically extends up to approximately 500 Hz, while for sensitized people who may have sensory impairments with other senses it may extend even up to approximately 1000 Hz. Thus, the vibrotactile sense, i.e. the sense of touch, supports human hearing in a considerable part of the perceivable audio frequency spectrum.

In parallel, active noise cancellation (ANC) technology for attenuating or even completely eliminating unwanted sounds within limited volumes are known in the art. Perhaps the most well-known application of ANC involves noise-cancelling headphones, where a microphone arrangement that serves to capture ambient noise around a user of the headphones is installed in the headphones, where an ANC processing unit generates 'anti-noise' that, when output to the user of the headphones, results in significantly attenuating or even completely eliminating the ambient noise captured by the microphone arrangement.

Quite obviously, such an ANC application is only capable of attenuating or eliminating audible perception of ambient noise, whereas the vibrotactile perception remains uncompensated for.

SUMMARY

Therefore, an object of the present invention is to provide a technique for comprehensive control, e.g. cancellation or attenuation, of ambient sound and vibration in accordance with one or more control signals. Such a technique enables, for example, creating a local silent zone where a user perceives being substantially isolated from any disturbances from his/her environment that could be conveyed via human auditory and/or vibrotactile perception.

According to an example embodiment, an apparatus for active cancellation of sound and vibration is provided, the apparatus comprising sound and vibration generation means for jointly producing vibration and sound under control of a driving signal provided as input thereto, said means arranged inside a padding to generate mechanical vibration that is perceivable as a vibration and sound on at least one outer surface of the padding and to radiate a sound through said at least one outer surface of the padding, feedback means for providing feedback information that is indicative of acoustic energy of sound and vibration inside the padding, and driving means for generating the driving signal in dependence of said feedback information so as to reduce energy of ambient sound and vibration induced inside the padding due to one or more external sources of sound and vibration.

In an example, the feedback means comprises a first sensor arranged to provide a first feedback signal that is descriptive of acoustic kinetic energy within the padding and a second sensor arranged to provide a second feedback signal that is descriptive of acoustic potential energy within the padding, and the feedback information comprises said first and second feedback signals. In this regard, the first sensor may comprise an accelerometer arranged to provide the first feedback signal that is descriptive of a velocity of movement within the padding and the second sensor may comprise a pressure sensor arranged to provide the second feedback signal that is descriptive of a sound pressure within the padding. In a further example, the driving means is arranged to derive a first cancellation signal by multiplying the first feedback signal by a first adaptable gain value, to derive a second cancellation signal by multiplying the second feedback signal by a second adaptable gain value and to generate the driving signal as a signal that includes a combination of the first and second cancellation signals.

The exemplifying embodiments of the invention presented in this patent application are not to be interpreted to pose limitations to the applicability of the appended claims. The verb "to comprise" and its derivatives are used in this patent application as an open limitation that does not exclude the existence of also unrecited features. The features described hereinafter are mutually freely combinable unless explicitly stated otherwise.

Some features of the invention are set forth in the appended claims. Aspects of the invention, however, both as to its construction and its method of operation, together with additional objects and advantages thereof, will be best understood from the following description of some example embodiments when read in connection with the accompanying drawings.

BRIEF DESCRIPTION OF FIGURES

The embodiments of the invention are illustrated by way of example, and not by way of limitation, in the figures of the accompanying drawings, where.

DESCRIPTION OF SOME EMBODIMENTS

Figure 1:
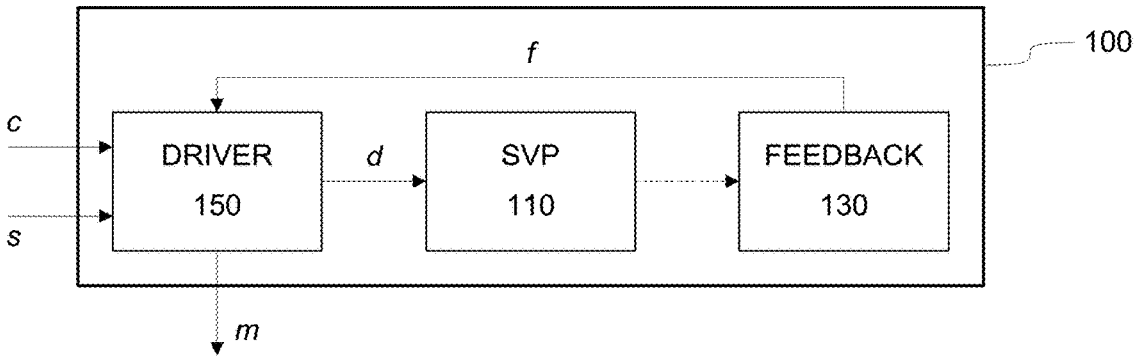
FIG. 1 depicts a block diagram of some logical components of an apparatus according to an example embodiment.

As described in the foregoing, parallel to hearing system through ears, the human auditory perception also involves receiving auditory information via other senses that are affected by acoustical excitation in an audio frequency range, especially via the sense of touch, which reacts to vibration both on skin and in inner tissues of the human body. Audible perception via the human hearing system through ears typically covers audible frequencies in a range from approximately 50 Hz to approximately 20 kHz, although the range may even significantly vary from person to person, whereas the sense of touch conveys auditory information at the lower end of the audible frequency range and below.

Considering the sense of touch in the audible frequencies and/or slightly below, cutaneous receptors on skin are able to capture information typically from 10 to 500 Hz. If the airborne sound transmitted by fluid (e.g. air or water) is intense enough, skin is vibrating and this vibrotactile perception supports the audible perception. Synchronic information from the sense of touch and from hearing support each other, thereby increasing the clarity of the perceived audio information. At lower vibrotactile audio frequencies, say frequencies below 100 Hz, mechanical vibration is easily propagating also to body parts located below skin, and vibration receptors in joints and muscles react to the audio signal. Vibration is further affecting deeper body parts with very low audio frequencies and infrasonic frequencies. Typically frequencies below 30 Hz are not audible by a human listener, and signal components at such frequencies are primarily perceived as body vibration via mechanical contact to the environment. Skin can also sense infrasound frequencies as pressure sensation or via various nonlinear mechanisms (e g clothes flapping towards skin).

While the sense touch is hence useful in conveying auditory information that is only partially perceivable via human hearing system or that is unperceivable via human hearing system for improved perception of auditory information, intense vibration may also have a harmful effect via interference with other senses: as an example, vibration at a low frequency transferred to head of a listener may disturb visual perception and thereby have a detrimental effect to a balance sense. Hence, while vibration stimulus may serve as an aid for human hearing for improved perception of sound, on the other hand, the vibration stimulus may have an undesired effect via conveying auditory information that may be perceived by a user as interference or discomfort or that may be received in a situation where the user wishes to avoid receiving any auditory or vibrotactile information.

Vibration stimulus may also be used for reducing perceivable sound and vibration exposure. At low frequencies, lack of vibration is perceived as lack of sound through the cross-coupling mechanisms of multisensory perception of hearing and tactile senses. In order to provide a comprehensive solution for cancelling or attenuating unwanted auditory and vibrotactile, simultaneous reduction of both ambient sound and ambient vibration is needed, and this reduction is preferably carried out in a balanced manner for perceptually good results.

This disclosure describes, via a number of non-limiting examples, a technique for controlling user-perceivable sound and vibration using a holistic approach that is based on observed local acoustic energy flow, where both airborne sound and structure-borne vibration can be controlled using a collocated feedback control system that may be based at least in part on surface intensity detection. In this regard, a control logic tracks ambient acoustic energy flow and aims at minimizing the energy density locally within a limited nearfield listening area, using radiated vibration energy. Consequently, a silent zone or volume may be created around the head of the user via taking into account both physical and perceptual acoustical aspects: a) ambient sound and vibration field via estimation of acoustic energy flow around the user and b) a residual perceived disturbance conveyed via loudness of sound and feelness (tactile percept) of structure-borne vibration received by the user.

Such a technique may be characterized as an active or semi-active control of sound and vibration. In an example, a system or an arrangement that implements the active or semi-active control of sound and vibration is provided in a cushion-like device that absorbs acoustic energy as such, and it uses active cancellation as additional means for reducing user perceived noise. In another example, such a system or arrangement is provided in a seat, such as a movie theatre seat, an airline seat, a seat of a motor vehicle, etc. In a seat arrangement, disturbing sound energy may originate from ambient sound radiation (mainly from front direction), or as structure-borne vibration received via the seat (mainly from back direction). These components of the acoustic energy flow can be distinguished, for example, by simultaneously measuring both sound pressure and vibration velocity.

A straightforward solution for providing the active or semi-active control of sound and vibration involves usage of a surface intensity probe arrangement that is integrated into a surface vibration actuator arrangement, various examples of which are described in the following. Unlike in previously known active sound or vibration control or cancellation systems that use either sound or vibration sensing, an acoustic energy flow based approach described in this disclosure provides an energy efficient and robust solution for actively cancelling or attenuating perceivable disturbances in audible and vibrotactile frequencies, be they airborne or structure-borne FIG. 1 depicts a block diagram of some (logical) components of an apparatus 100 according to an example. The apparatus 100 comprises a sound and vibration generating arrangement 110 that is arranged to jointly produce vibration and sound under control of a driving signal d provided as input thereto. The sound and vibration generating arrangement 110 is provided inside a padding to generate mechanical vibration that is perceivable as a vibration and sound on at least one outer surface of the padding and to radiate a sound through said at least one outer surface of the padding for active cancellation of sound and vibration. The apparatus 100 further comprises a feedback arrangement 130 that is arranged to provide feedback information f that is indicative of observed acoustic energy of sound and vibration inside the padding and a driving arrangement 150 that is arranged to generate, in dependence of the feedback information f, the driving signal d so as to reduce the energy of ambient sound and vibration inside the padding. The apparatus 100 may further receive, via the driving arrangement 150, an input audio signal s for reproduction using the sound and vibration generating arrangement 110.

FIG. 1 further depicts an optional input control signal c that may be applied for controlling operation of the driving arrangement 150 e.g. by simply enabling turning operation of the apparatus 100 on or off and/or by providing one or more control parameters that enable controlling or adjusting operation of the apparatus 100. FIG. 1 also depicts an optional measurement signal m that may be output from the driving arrangement 150 e.g. to an external control and/or monitoring unit. The measurement signal m is indicative of observed sound and vibration inside the padding. The measurement signal m may carry, for example, one or more indications concerning observed acoustic energy of sound and vibration inside the padding.

The sound and vibration inside the padding indicated by the feedback information f may include one or both of the following components:

sound and vibration caused by the operation of the sound and vibration generating arrangement in order to reproduce the input audio signal s, ambient sound and vibration induced inside the padding due to external sources of sound and/or vibration.

The local control loop provided by operation of the feedback arrangement 130 and the driving arrangement 150 serves to drive the sound and vibration generating arrangement 110 in a manner that aims at locally minimizing the ambient sound and vibration induced inside the padding. Hence, in case the input audio signal s is being provided, the operation of the apparatus 100 aims at cancelling or at least attenuating the ambient sound and vibration induced inside the padding due to external sources to enable undisturbed listening of the input audio signal s, whereas in case no input audio signal s is being provided, the apparatus serves to provide a local silent volume or silent zone where the acoustical information originating from external sources that would be otherwise conveyed via sense of touch and/or via human hearing is attenuated or even completely cancelled. Due to this aspect of its operation, the apparatus 100 may be also referred to as an active sound and vibration cancellation apparatus 100 or, in short, as an active vibration element (AVE) 100. Various examples concerning operation of the AVE 100 are provided in the following.

The sound and vibration generating arrangement 110 may be also referred to as a sound and vibration generating means 110 to reflect the fact that there is a plurality of ways to implement such an arrangement for joint production of sound and vibration. In this regard, some non-limiting examples are provided later in this text. In the following we predominantly refer to the sound and vibration generating arrangement 110 as sound/vibration reproduction (SVR) means 110. Along similar lines, in the following the feedback arrangement 130 is predominantly referred to as a feedback means 130 and the driving arrangement 150 is referred to as a driving means 150.

Figure 2:
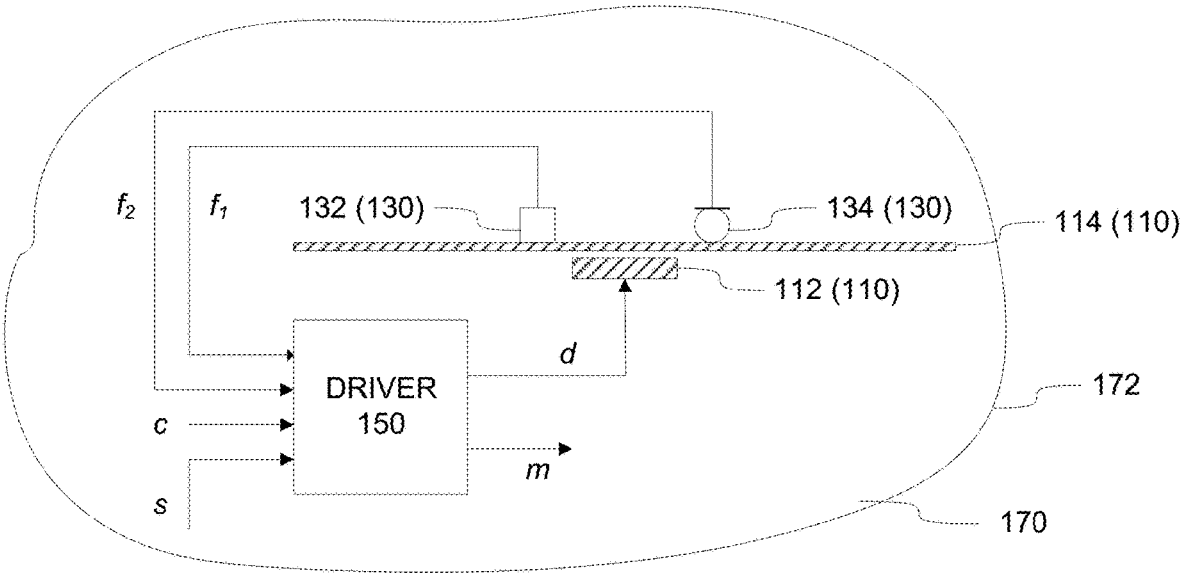
FIG. 2 schematically illustrates an active vibration element apparatus according to an example embodiment.

FIG. 2 schematically illustrates the AVE 100 according to an example. In the example of FIG. 2, the SVR means 110 comprises a mechanical actuator 112 arranged to vibrate a board 114 in accordance with the driving signal d received from the driving means 150. FIG. 2 further shows a padding 170 that serves to enclose the AVE 100 such that the SVR means 110 is elastically mounted to the padding 170. The board 114 is made of material that is more rigid than the padding 170 and hence the vibration caused in the board 114 by operation of the mechanical actuator 112 is transferred by the padding 170 to an outer surface 172 of the padding 170. Consequently, the vibration generated by the SVR means 110 is perceivable as vibration and sound on at least part of the outer surface 172 of the padding 170 and it also radiates as sound through at least part of the outer surface 172 of the padding 170. In an example, the outer surface 172 constitutes an integral part of the padding 170 and it is made of the same material as immediately adjacent portion of the padding 170. In another example, the outer surface 172 may be provided as a separate wrapping that is made of material different from that of the immediately adjacent portion of the padding 170.

The padding 170 comprises or it is made of porous material that, on one hand mechanically dissipates the vibration generated by operation of the SVR means 110 and acoustically absorbs sound generated by operation of the SVR means 110. This dissipation and absorption serves to attenuate noise signals especially at high frequencies, which is beneficial for operating the apparatus 100 for active cancellation of sound and vibration since high-frequency noise is typically difficult to cancel or attenuate via operation of the SVR means 110. On the other hand, the padding 170 nevertheless serves to transfer the sound and vibration resulting from operation of the SVR means 110 to its outer surface 172, thereby contributing towards synchronous reception of the sound and vibration by the user. Therefore, the padding 172 serves also as energy transmission means in addition to serving as energy dissipating means in order to provide damping of resonances and also damping of external/ambient acoustical noise to some extent.

In this regard, inherent mechanical dissipation referred to above is advantageous for active control purposes as a) it attenuates the ambient sound and vibration as such and b) it can be used as one element of active absorption control scheme. Typically, active noise cancellation does not actually reduce the sound energy but rather increases it while it serves to direct the ambient energy away from the silent zone. Previously known active systems for noise cancellation typically create a high amount of energy at relatively poor energy efficiency. In contrast, the near-field approach described in this disclosure makes use of sensing and actuation capabilities of the AVE 100 in a holistic manner and thereby provides an energy efficient means for creating the silent zone or silent volume around the user.

As an example, the mechanical actuator 112 may comprise a moveable magnet mechanically connected or suspended to the board 114, and the vibration is generated by driving the movement of the moveable magnet by the driving signal d. In particular, the magnet of this example is moveable with respect to the padding 170 that surrounds the SVR means 110. In this example, the board 114 is rigid or substantially rigid, thereby moving in its entirety with movement of the moveable magnet. In a variation of this example, the moveable magnet may be a magnet assembly of a loudspeaker element, which loudspeaker element is mechanically connected to the board 114.

In another example, the mechanical actuator 112 may comprise a piezoelectric or magnetostrictive element integrated to the board 114, which piezoelectric or magnetostrictive element causes deformations of the board 114 in accordance with the driving signal d. In this example, the board, although more rigid than the padding 170 surrounding it, is flexible to an extent allowing the deformations driven thereto via operation of the piezoelectric or magnetostrictive element that serves as the mechanical actuator 112.

Although depicted in FIG. 2 and described in the above examples with a single actuator 112 and a single board 114, in other examples the (single) actuator 112 may be arranged to vibrate two or more boards 114, two or more actuators 112 may be arranged to vibrate the (single) board 114 or two or more actuators 112 may be arranged to vibrate two or more boards 114 in accordance with the driving signal d. In general, the exemplifying SVR means 110 of FIG. 2 generalizes into one comprising at least one mechanical actuator 112 and at least one board 114, wherein said at least one mechanical actuator 112 is arranged to vibrate the at least one board 114 in accordance with the driving signal d received from the driving means 150.

In general, the feedback means 130 may comprise a first sensor that is arranged to provide a first feedback signal $f_1$ that is descriptive of acoustic kinetic energy within the padding 170 and a second sensor that is arranged to provide a second feedback signal $f_2$ that is descriptive of acoustic potential energy within the padding 170. Referring to the example of FIG. 2, the feedback means 130 may comprise an accelerometer 132 as the first sensor and a pressure sensor 134 as the second sensor. The accelerometer 132 and the pressure sensor 134 are arranged in close proximity to each other. In other words, the accelerometer 132 and the pressure sensor 134 are co-located with each other and the driving means 150. In FIG. 2, the pressure sensor 134 is depicted as a microphone, but a pressure sensor of other type may be applied instead. The accelerometer 132 is communicatively coupled to the driving means 150 and it is arranged to provide the first feedback signal $f_1$ from the feedback means 130 to the driving means 150. The first feedback signal $f_1$ conveys feedback information that is descriptive of velocity of movement within the padding 170 due to vibration induced therein. The velocity is derivable from the first feedback signal $f_1$ obtained from the accelerometer 132 as a time integral of the measured acceleration indicated by the first feedback signal $f_1$. The pressure sensor 134 is communicatively coupled to the driving means 150 and it is arranged to provide the second feedback signal $f_2$ from the feedback means 130 to the driving means 150. The second feedback signal $f_2$ conveys feedback information that is descriptive of sound pressure within the padding 170. The first and second feedback signals $f_1$ and $f_2$ hence serve as the feedback information f referred to in the foregoing.

In the example of FIG. 2 the accelerometer 132 and the pressure sensor 134 are depicted as elements that are directly coupled to the board 114. This, however, is a non-limiting example and an arrangement of other type may be used instead. As an example in this regard, one or both of the accelerometer 132 and the pressure sensor 134 may be integrated or attached to the driving means 150 instead. As another exemplifying variation, one or both of the accelerometer 132 and the pressure sensor 134 may be provided in an entity separate from the board 134 (or the SVR means 110 in general) and from the driving means 132. Nevertheless, the task of the accelerometer 132 and the pressure sensor 134 (or the feedback means 130 in general) is to provide the feedback information that enables computing or otherwise estimating the acoustic energy of the sound and vibration within the padding 170 and hence arranging them at or close to the board 114 provides an advantage via directly observing the acoustic energy component resulting from vibrations caused to the board 114 without damping caused by the padding 170.

Arrangement of the accelerometer 132 and the pressure sensor 134 spatially close to each other at or in close proximity to the board 114 ensures that they serve to provide feedback information in a synchronized manner with a small (propagation) delay that in a typical implementation can be considered negligible. Consequently, the control loop (or a feedback loop) to the driving means 150 is robust and insensitive to small changes in operating parameters or operating conditions of the AVE 100.

Typically, previously known active noise cancellation systems use a set of microphones to provide feedback signal(s) that represent sound pressure and hence provides an indication of acoustic potential energy. While such an approach may provide satisfactory performance in some applications, using feedback information concerning acoustic kinetic energy e.g. via indication of vibration velocity in parallel to sound pressure information enables improved performance: having respective indications of both acoustic potential energy (e.g. sound pressure) and acoustic kinetic energy (e.g. vibration velocity) enables direct energy quantities (energy density, impedance, intensity) to be utilised in monitoring and control of sound and vibration. This approach is employed in the AVE 100, enabling the AVE 100 to adapt itself to a local (surface) intensity sensor that provides an estimate of acoustic energy flow vector component. In this regard, the AVE 100 may be considered as a local directed sensor/actuator that measures ambient sound and vibration energy flow and controls it with directional properties.

The advantageous effect arising from usage of both the acoustic potential energy feedback and the acoustic kinetic energy feedback is further discussed in the following by using sound pressure feedback and vibration velocity feedback as respective examples. Denoting measured or observed sound pressure by p and the measured or observed vibration velocity by v, the sound pressure squared $p^2$ is proportional to acoustic potential energy and the velocity squared $v^2$ is proportional to acoustic kinetic energy, while their ratio of the sound pressure p and the velocity v in frequency domain (denoted as P and V, respectively) represents impedance, i.e. $Z=P/V$. The product of the sound pressure p and the velocity v, i.e. $p*v$, represents instantaneous intensity that serves as an indication of local acoustic energy flow. In frequency domain, their complex conjugate product $P*V$ represent averaged (complex) intensity. Net acoustic energy flow amplitude and direction may be obtained from the real part of the complex intensity. As described in the foregoing, when an acceleration sensor is used to provide vibration velocity feedback, the vibration velocity v may be obtained as a time integral of measured acceleration a. In frequency domain, this may be accomplished by dividing the acceleration in frequency domain, denoted as A, by angular frequency ω as $V=A/\omega$. Consequently, in frequency domain, the impedance Z may be obtained from a frequency response between the pressure P and the acceleration A, denoted as $H_{ap}=P/A$, by using the relationship $Z=j\omega H_{ap}$. Moreover, complex intensity estimate I may be obtained as $I=P*A/j\omega=P*P(j\omega H_{ap})^{-1}$.

Using only pressure feedback (as in known solutions) enables minimising the sound pressure, but this usually increases the vibration, ideally driving impedance to zero. Consequently, while acoustic energy conveyed directly via human hearing is at or close to zero, thereby resulting in a substantially silent location, the vibrotactile sense still conveys the (increased) vibration that the user typically at least partially perceives as auditory information. Improved perceivable result is achievable by using also feedback that indicates the acoustic kinetic energy quantities (e.g. the vibration velocity v) in parallel with the feedback that indicates the acoustic potential energy e.g. as the direct sound pressure p e.g. by suitably adjusting respective gain values that control contribution from the velocity feedback (e.g. feedback signal $f_1$) and the pressure feedback (e.g. the feedback signal $f_2$) in derivation of the driving signal d, as will be described in the following via non-limiting examples.

Still referring to the example of FIG. 2, the driving means 150 may be provided by hardware means or by a combination of hardware means and software means. As an example for the latter, the driving means 150 may be provided by an apparatus comprising a processor and a memory, which memory is arranged to store computer program code that comprises computer-executable instructions that, when executed by the processor, cause the apparatus to derive the driving signal d in dependence of the feedback information received in the first and second feedback signals $f_1$ and $f_2$, possibly under control of one or more control parameters received in the control signal c. Herein, reference(s) to a processor should not be understood to encompass only programmable processors, but also dedicated circuits such as field-programmable gate arrays (FPGA), application specific circuits (ASIC), signal processors, analog electrical circuits, etc.

The generation of the driving signal d in the driving means 150 aims at deriving a driving signal d that causes the SVR means 110 to produce sound and vibration that serves to cancel or substantially attenuate the observed ambient sound and vibration indicated by the first and second feedback signals $f_1$ and $f_2$. In this regard, the first and second feedback signals $f_1$ and $f_2$ are used as basis for generating a signal that is fed back to the SVR means 110 as the driving signal d or as a component thereof in order to cancel or attenuate the observed ambient sound and vibration.

Figure 3:
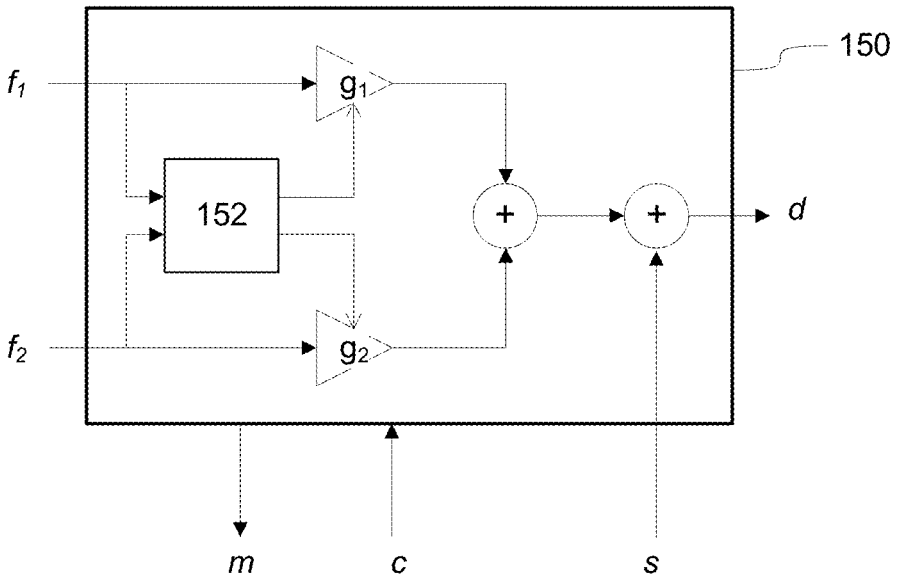
FIG. 3 depicts a block diagram of some logical components of a driving portion according to an example embodiment.

As an example in this regard, FIG. 3 depicts a block diagram of some logical components of an arrangement that may be employed to generate the driving signal d on basis of the first and second feedback signals $f_1$ and $f_2$ as part of operation of the driving means 150. As an overview of operation of the arrangement of FIG. 3, the operation of the driving means 150 is adapted by operation of an adaptation means 152 in accordance with the first and second feedback signals $f_1$ and $f_2$. The adaptation means 152 receives the first and second feedback signals $f_1$ and $f_2$ and sets values for first and second adaptable gains $g_1$ and $g_2$ according to a predefined adaptation rule in dependence of the first and second feedback signals $f_1$ and $f_2$. The first feedback signal $f_1$ is multiplied by the first gain $g_1$ to generate a first cancellation signal, whereas the second feedback signal $f_2$ is multiplied by the second gain $g_2$ to generate a second cancellation signal. Each of the first and second cancellation signals is combined (e.g. added) to the input audio signal s to form the driving signal d. In a scenario where no input audio signal s is present, the driving signal d is formed as a combination (e.g. as a sum) of the first and second cancellation signals.

The adaptation rule may aim at driving the vibration (represented by the first feedback signal $f_1$), the sound pressure (represented by the second feedback signal $f_2$) or both to zero, thereby attenuating or cancelling the ambient sound and/or vibration induced inside the padding 170. This may be accomplished by the adaptation means 152 setting respective values for the first and second gains $g_1$ and $g_2$ according to the adaptation rule. Non-limiting examples of the adaptation rule are outlined in the following:

- The adaptation rule may set the first gain $g_1$ to zero and select the value for the second gain $g_2$ such that the sound pressure indicated by the second feedback signal $f_2$ is minimized while the due to zero value of the first gain $g_1$ the vibration is not actively attenuated or cancelled. This approach aims at reducing or minimizing the potential energy of the ambient sound and vibration inside the padding 170.
- The adaptation rule may set the second gain $g_2$ to zero and select the value for the first gain $g_1$ such that the vibration indicated by the first feedback signal $f_1$ is minimized while the due to zero value of the second gain $g_2$ the audible sound is not actively attenuated or cancelled. This approach aims at reducing or minimizing the kinetic energy of the ambient sound and vibration inside the padding 170.
- The adaptation rule may select respective values for the first gain $g_1$ and the second gain $g_2$ such that the vibration and the sound pressure indicated, respectively, by the first and second feedback signals $f_1$ and $f_2$ are minimized. This approach aims at reducing or minimizing the overall energy, i.e. both kinetic energy and potential energy of the ambient sound and vibration inside the padding 170.
- The adaptation rule may set one of the first and second gains $g_1$ and $g_2$ to zero and select the value for the other one to minimize the sound pressure or the vibration in dependence of (residual) intensity direction that may be derived on basis of the complex intensity estimate I described in the foregoing. In this regard, the complex intensity estimate I is derivable on basis of the first and second feedback signals $f_1$ and $f_2$: the frequency domain acceleration A is derivable from the first feedback signal $f_1$, the frequency domain pressure P is derivable from the second feedback signal $f_2$, whereas the frequency response $H_{ap}$ is provided as a predefined value stored in the adaptation means 152. If the intensity direction indicates a first direction (e.g. a forward direction), the second gain $g_2$ may be set to zero and the adaptation rule operates to select the value for the first gain $g_1$ such that sound pressure within the padding 170 is minimized, whereas in case the intensity direction indicates a second direction (e.g. a backward direction), the first gain $g_1$ may be set to zero and the adaptation rule operates to select the value for the second gain $g_2$ such that vibration within the padding 170 is minimized.

In any of the exemplifying adaptation rules the adaptation of the first and/or second gains $g_1$ and/or $g_2$ may employ an adaptive parameter estimation technique known in the art, such as recursive least squares method or gradient descent method.

Figure 4:
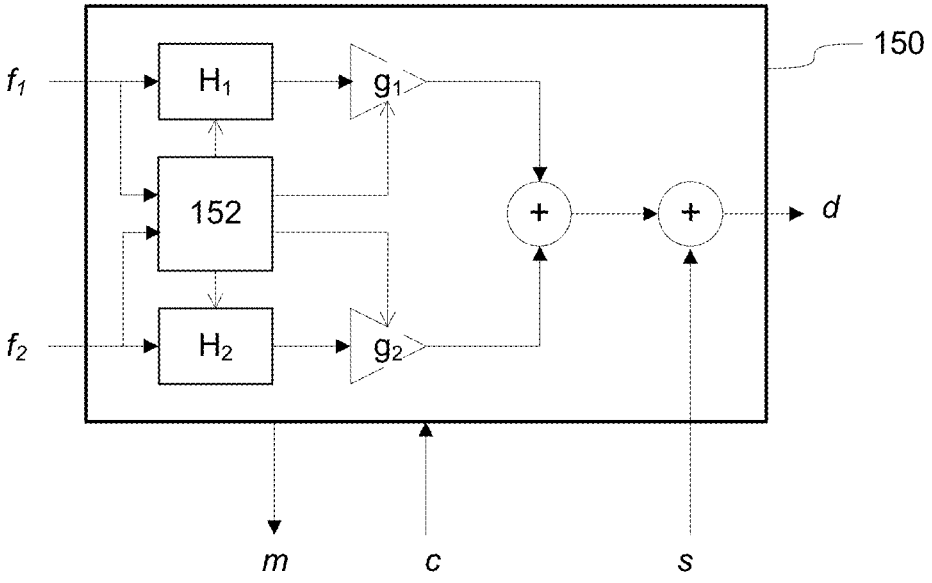
FIG. 4 depicts a block diagram of some logical components of a driving portion according to an example embodiment.

FIG. 4 depicts a block diagram of some logical components of another arrangement that may be employed to generate the driving signal d on basis of the first and second feedback signals $f_1$ and $f_2$ as part of operation of the driving means 150. This arrangement is similar to that illustrated in FIG. 3, with the addition of first and second compensation filters $H_1$ and $H_2$. The first compensation filter $H_1$ serves to compensate for phase and/or amplitude in the first feedback signal $f_1$ by modeling an inverse of a transfer function from the driving signal d to the first feedback signal $f_1$, whereas the second compensation filter $H_2$ serves to compensate for phase and/or amplitude in the second feedback signal $f_2$ by modeling an inverse of a transfer function from the driving signal d to the second feedback signal $f_2$. The compensation filters $H_1$ and $H_2$ enable an improvement in adaptation performance and stability with a cost of some increase in computational load.

In a first example according to the arrangement depicted in FIG. 4, the adaptation means 152 receives the first and second feedback signals $f_1$ and $f_2$ and sets values for first and second adaptable gains $g_1$ and $g_2$ according to a predefined adaptation rule in dependence of the first and second feedback signals $f_1$ and $f_2$, whereas the respective sets of filter coefficients that define the first and second compensation filters $H_1$ and $H_2$ have fixed predefined values. Hence, the operation is similar to that described in context of the arrangement of FIG. 3 with the following exceptions:

- in addition to multiplying the first feedback signal $f_1$ by the first gain $g_1$ the first feedback signal $f_1$ is also processed by the first compensation filter $H_1$ before using it as the first cancellation signal; and
- in addition to multiplying the second feedback signal $f_2$ with the second gain $g_2$ the second feedback signal $f_2$ is also processed by the second compensation filter $H_2$ before using it as the second cancellation signal.

Although FIG. 4 depicts a processing chain where processing by the first compensation filter $H_1$ is applied before multiplication by the first gain $g_1$, the processing order in this regard may be reversed such that multiplication by the first gain $g_1$ occurs before processing by the first compensation filter $H_1$. Similar considerations apply also to the processing order of the second compensation filter $H_2$ and the second gain $g_2$.

The selection or definition of the fixed predefined values for respective sets of filter coefficients for the first and second compensation filter $H_1$ and $H_2$ may be carried out in a filter calibration procedure that takes place before operating the AVE 100, e.g. as part of the manufacturing or maintenance process or during initialization, installation, configuration or re-configuration of the AVE 100. Such a filter calibration procedure may serve to find a first set of filter coefficients for the first compensation filter $H_1$ such that it estimates a first transfer function $H_{da}$ from the driving signal d to the first feedback signal $f_1$ and to find second set of filter coefficients for the second compensation filter $H_2$ such that it estimates a second transfer function $H_{dp}$ from the driving signal d to the second feedback signal $f_2$. In this scenario, the filter calibration procedure may be carried out using a calibration signal that has a sufficient signal-to-noise ratio (SNR) as the driving signal d, e.g. a signal that results in the SVR means 110 generating sound and vibration energy that is high enough compared to the energy of the ambient sound and vibration induced in the padding 170. As an example, the SNR may be considered sufficient if the sound and vibration energy generated by the SVR means 110 exceeds a predefined SNR threshold, which serves as an indication that the energy of the ambient sound and vibration by at least a predefined margin. In an example, a sufficient SNR for the calibration signal may be ensured by carrying out the calibration procedure in conditions where the energy of the ambient sound and vibration is known to be below a certain predefined threshold and/or the characteristics and/or where other characteristics of the ambient sound and vibration are known. As an example in this regard, suitable conditions for the calibration procedure may be indicated or detected when the feedback information f (e.g. the first and second feedback signals $f_1$ and $f_2$ hence) indicates energy of ambient sound and vibration is below the certain predefined threshold.

In an example, the calibration signal comprises a specific signal dedicated or designed for this purpose. In another example, the calibration signal may comprise any signal that has sufficient energy at frequencies or frequency ranges of interest. In an example, the calibration signal is provided as the input audio signal s while operating the AVE 100 in a filter calibration mode. In another example, operation in the filter calibration mode automatically results in disregarding the input audio signal s and using a calibration signal stored in a memory in the AVE 100 instead or combining (e.g. adding) the calibration signal stored in the memory to the input audio signal s. The AVE 100 may be switched to operate in the filter calibration mode e.g. by providing a predefined filter calibration command in the control signal c (and, conversely, may be switched to normal operation mode e.g. providing a predefined command in this regard in the control signal c).

In a variation of the first example described in the foregoing, the sets of filter coefficients may be redefined during operation of the AVE 100 by carrying out the filter calibration procedure in the course of the AVE 100 operation to re-determine the first and second sets of filter coefficients, thereby obtaining the first and second sets of filter coefficients of predefined values that are not fixed in a sense that they may be changed or redefined during the course of the AVE 100 operation. Also in this scenario, the filter calibration operation may be initiated (and terminated) and the calibration signal may be provided as described in the foregoing.

In a second example according to the arrangement depicted in FIG. 4, the operation is similar to the first example described in the foregoing with the exception that the filter coefficients in the respective sets of filter coefficients for the first and second compensation filters $H_1$ and $H_2$ have adaptable values that may be adapted during operation of the AVE 100. The difference to the above-described operation where the filter calibration operation may be initiated during operation of the AVE 100 is that in this second example the filter coefficients are adapted (e.g. redefined) without an explicit command in this regard. The adaptation may be substantially continuous or it may be carried out intermittently e.g. according to a predefined schedule. As an example in this regard, the adaptation of the filter coefficient values may be based on using the input audio signal s as such as the driving signal d. In another example, the adaptation of the filter coefficient values may employ a modified input audio signal s as the driving signal d where the modification involves combining (e.g. adding) a calibration signal stored in a memory in the AVE 100 to the input audio signal s to form the driving signal d.

FIGS. 3 and 4 also illustrate a monitoring signal m that may be provided as output from the driving means 150 (and possibly from the AVE 100). The monitoring signal m may convey one or more pieces of information that are descriptive of operation of the AVE 100. As an example in this regard, the monitoring signal may carry information that is descriptive of one or more of the following: coherence estimate of one or more of the measured transfer functions $H_{da}$ and $H_{dp}$, the intensity direction, the impedance Z current calibration state of a component of the driving means 150 (e.g. one or both of the compensation filters $H_1$ and $H_2$), values of one or more of the first and second gains $g_1$ and $g_2$, the first and/or second feedback signals $f_1$ and/or $f_2$, etc.

FIGS. 3 and 4 also illustrate the control signal c that may be provided as input to the driving means 150 (and possibly to the AVE 100). The control signal c may be employed to convey one or more commands or operating parameters to control operation of the driving means 150 and hence control operation of the AVE 100. Examples in this regard include the commands for setting the driving means 150 (and the AVE 100 in general) to operate or from operating in the filter calibration mode. Further examples of commands or operating parameters include (pre)defined values for one or more of the following: the first gain $g_1$, the second gain $g_2$, the first set of filter coefficients (for the first compensation filter $H_1$), the second set of filter coefficients (for the second compensation filter $H_2$). In another example, the control signal c may comprise a conventional ANC control signal, such as a feedforward signal obtained from external sensors that are arranged to measure external sound and vibration sources.

In the above examples the definition, redefinition and/or adaptation of respective sets of filter coefficients for the first and second compensation filters and definition of respective values for the first and second gains $g_1$ and $g_2$ are carried out in the adaptation means 152 that is provided as part of the driving means 150. This, however, serves as a non-limiting example and the adaptation means 152 may be provided separately from other aspects of the driving means 150 described in the foregoing. As an example in this regard, the monitoring signal m may be arranged to convey information that enables setting the first and second gains $g_1$ and $g_2$ and possibly also the filter coefficients for the compensation filters $H_1$ and $H_2$ (e.g. by conveying the first and second feedback signals $f_1$ and $f_2$ or information derived therefrom in the monitoring signal m) to the adaptation means 152, whereas the control signal c may be employed to deliver the first and second gain values $g_1$ and $g_2$ and possibly also the filter coefficients to the driving means 150. Such an approach enables providing the adaptation means 152 in a centralized control entity that may serve a plurality of AVEs 100.

An adaptive mechanism, like the ones depicted in FIGS. 3 and 4, enable better control performance in cases the operation conditions of the AVE 100 change. These changes may be due to e g user head movement, or user back or neck pressing the cushion or the seat arrangement that includes the AVE 100. Adaptive adjustment or selection of the first and second gains $g_1$ and $g_2$ may be needed also e.g. in cases where ambient sound or vibration energy exceeds the driving capabilities of actuation mechanisms. In such a scenario, it is beneficial to limit the driving signal d e.g. by setting respective values of the first and second gains $g_1$ and $g_2$ close to zero or to a value that is close to zero in order to avoid clipping or distortion in driver output.

The AVE 100 described via a number of examples in the foregoing may be provided in entities of various types depending on the desired application. As an example, the AVE 100 may be provided as part of the cushion of the type described in the international patent application published as WO 2015/118217 A1. Such application of the AVE 100 enables using the cushion e.g. to create a local silent volume or silent zone that encompasses the head of a user when resting his/her head against the cushion.

In another example, the AVE 100 may be integrated to a chair of seat. In this regard, the seat may be, for example, an armchair for home or office use, seat of a vehicle, such as an airline seat, a car seat, a seat of a bus, etc. Preferably, the AVE 100 is arranged in a backrest of the chair or seat such that it is located in close proximity of the head of a person sitting in the chair or seat. Such an application of the AVE 100 enables creating a local silent volume or silent zone that encompasses at least the head of a user when seated in the chair or seat.

Figure 5:
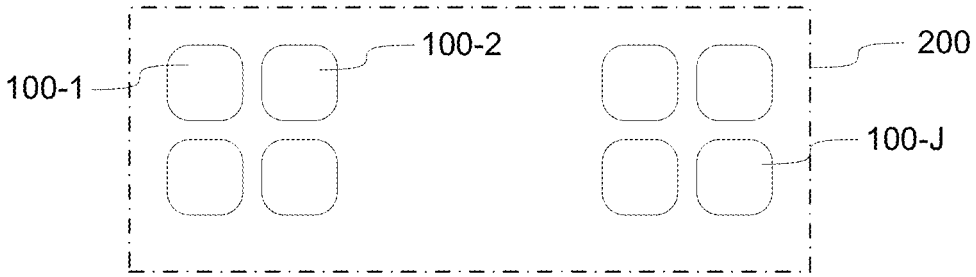
FIG. 5 schematically illustrates an active vibration element array according to an example embodiment.

FIG. 5 schematically illustrates an arrangement 200 comprising two or more AVEs 100-*j*, where each of the AVEs 100-*j* (j=, 1, 2, . . . , J) comprises and AVE 100 described via a number of examples in the foregoing. Such an arrangement may be referred to as an AVE array 200 or an array of AVEs 200. In the non-limiting example of FIG. 5, the AVE array 200 comprises four sub-arrangements (or sub-arrays) of four AVEs 100-*j*. In the AVE array 200, each of the AVEs 100-*j* is arranged in a predefined position with respect to other AVEs 100-*j* and/or with respect to a reference point. The AVEs 100-*j* in the AVE array 200 may be arranged in any desired constellation, e.g. as a single matrix of desired number of rows and columns, as a plurality of (sub-) matrices each having a respective desired number of rows and columns or, in general, into an arbitrary positions with respect to each other (and/or the reference point).

In an example, each of the AVEs 100-*j* may be enclosed inside its respective padding 170 that is separate from paddings enclosing any of the other AVEs 100-*j*, the arrangement of a single AVE 100-*j* with respect to the padding thereby corresponding to that depicted in the of FIG. 2. In another example, an AVE 100-*j* shares a padding with one or more other AVEs 100-*j*. Regardless of an AVE 100-*j* being arranged inside a dedicated padding or within the same padding with one or more other AVEs 170-*j*, each AVE 100-*j* nevertheless has its respective feedback means 130 locally positioned at or in immediate proximity of its SVR means 110 to ensure correct operation of the local control loop. Therefore, each AVE 100-*j* of the AVE array 200 operates independently of other AVEs 100-*j* of the AVE array 200. Consequently, the AVE array 200 is able to respond to local variations in the observed ambient sound and vibration, which in turn enables active cancellation of sound and vibration at improved accuracy via independent operation of the AVEs 100-*j* that constitute the AVE array 200 while it at the same time enables creating an extended local silent volume or silent zone (in comparison to using a single AVE 100).

While each AVE 100-*j* of the AVE array 200 operates according to its local control loop, the AVE array 200 enables parallel global control of the AVES 100-*j* of the array. Such global control may be implemented, for example, by feeding the AVEs 100-*j* with suitably selected respective input audio signals s that serve to steer the sound and vibration cancelling operation in the individual AVEs 100-*j* in a desired manner. In another example, the AVEs 100-*j* of the AVE array 200 may be provided with respective separate control inputs that enables controlling operation of the respective AVE 100-*j*. An example of such global control involves controlling operation of each AVE 100-*j* in dependence of the measurement signals m received from the neighboring AVEs 100-*j* of the array and/or audio input signals s provided for reproduction by the neighboring AVEs 100-*j* of the array: due to arrangement of the AVEs 100-*j* in close proximity to each other, a certain AVE 100-*j* may consider sound and vibration resulting from operation of one or more neighboring AVEs 100-*j* as ambient sound and vibration, while the global control that takes into account the measurement signals m received from and/or the audio input signals provided to the neighboring AVE(s) 100-*j* such that the certain AVE 100-*j* does not attempt to cancel or attenuate the sound and vibration intentionally generated in the neighboring AVE(s) 100-*j*.

As described in the foregoing, each of the AVEs 100-*j* in the AVE array 200 may provide the respective measurement signal m and may be able to receive the respective input audio signal s. In this regard, the measurement signals m may be employed e.g. to track changes in the ambient sound and vibration over the AVE array 200 over time. For example if the AVE array 200 is provided inside a chair/seat (e.g. in the backrest), a movement or a change of position of a person seated in the chair/set results in a synchronized or substantially synchronized change in the respective measurement signals m from the individual AVEs 100-*j*.

In case the AVE array 200 is also employed for audio reproduction, the same audio signal may be provided for playback as the respective input audio signal s for each of the AVEs 100-*j*. Consequently, the audio may be played back throughout the AVE array 200 to provide an extended area for enhanced audio perception via vibration and sound while at the same time cancelling or attenuating the ambient sound and vibration. In another example, different audio signals may be provided for respective predefined subsets of AVEs 100-*j* of the AVE array 200. As an example in this regard, a first audio channel of a multi-channel audio signal may be provided for playback as the respective input audio signal s for AVEs 100-*j* of a first predefined sub-group (e.g. the four AVEs 100-*j* on the left side of the illustration of FIG. 5) while a second audio channel of the multi-channel audio may be provided for playback as the respective input audio signal s for AVEs 100-*j* of a second predefined sub-group (e.g. the four AVEs 100-*j* on the right side of the illustration of FIG. 5). As a non-limiting example, the first channel may be a right channel of a stereo audio signal and the second channel may be a left channel of the stereo audio signal. In a further example, the tracking of changes in the ambient sound and vibration over the AVE array 200 over time on basis of the measurement signals m received from the AVEs 100-*j* of the array may be employed to steer the audio reproduction e.g. such that the AVEs 100-*j* that are employed for playback of the desired audio signal are dynamically selected in accordance with the tracking. In this regard, the dynamic selection may involve providing the desired audio signal as the input audio signal s to those AVEs 100-*j* that are located at the assumed (i.e. tracked) position of the user, whereas no audio input signal may be provided to those AVEs 100-*j* that are not located at the assumed (i.e. tracked) position of the user.

In the description in the foregoing, although some functions have been described with reference to certain features, those functions may be performable by other features whether described or not. Although features have been described with reference to certain embodiments or examples, those features may also be present in other embodiments or examples whether described or not.

The invention claimed is:

1. An apparatus for active cancellation of sound and vibration, the apparatus comprising a padding (170) and sound and vibration generation means (110) for jointly producing vibration and sound under control of a driving signal (d) provided as input thereto, said sound and vibration generation means (110) arranged inside the padding (170) to generate mechanical vibration that is perceivable as a vibration and sound on at least one outer surface (172) of the padding (170) and to radiate a sound through said at least one outer surface (172) of the padding (170);

feedback means (130) for providing feedback information (f) that is indicative of acoustic energy of sound and vibration inside the padding (170); and driving means (150) for generating the driving signal (d) in dependence of said feedback information (f) so as to reduce energy of ambient sound and vibration induced inside the padding (170) due to one or more external sources of sound and vibration, wherein the feedback means (130) comprises a first sensor arranged to provide a first feedback signal ($f_1$) that is descriptive of acoustic kinetic energy within the padding (170), and a second sensor arranged to provide a second feedback signal ($f_2$) that is descriptive of acoustic potential energy within the padding (170); and the feedback information (f) comprises said first and second feedback signals ($f_1$, $f_2$).

2. An apparatus according to claim 1, wherein the first sensor comprises an accelerometer (132) arranged to provide the first feedback signal ($f_1$) that is descriptive of a velocity of movement within the padding (170); and the second sensor comprises a pressure sensor (134) arranged to provide the second feedback signal ($f_2$) that is descriptive of a sound pressure within the padding (170).

3. An apparatus according to claim 1, wherein the driving means (150) is arranged to derive a first cancellation signal by multiplying the first feedback signal ($f_1$) by a first adaptable gain value ($g_1$);

derive a second cancellation signal by multiplying the second feedback signal ($f_2$) by a second adaptable gain value ($g_2$); and generate the driving signal (d) as a signal that includes a combination of the first and second cancellation signals.

4. An apparatus according to claim 3, wherein the driving means (150) is arranged to generate the driving signal (d) as the sum of the first and second cancellation signals.

5. An apparatus according to claim 3, wherein the driving means (150) is arranged to receive an input audio signal (s) for reproduction by the sound and vibration generation means (110); and generate the driving signal (d) as the sum of said input audio signal (s), the first cancellation signal and the second cancellation signal.

6. An apparatus according to claim 3, further comprising an adaptation means (152) arranged to carry out one of the following:

derive respective values of the first and second adaptable gains ($g_1$, $g_2$) such that the energy of the driving signal (d) is minimized, thereby reducing both the kinetic energy and the potential energy of ambient sound and vibration induced inside the padding (170);

set the value of the first adaptable gain ($g_1$) to zero and derive the value of the second adaptable gain ($g_2$) such that the energy of the driving signal (d) is minimized, thereby reducing the potential energy of ambient sound and vibration induced inside the padding (170);

set the value of the second adaptable gain ($g_2$) to zero and derive the value of the first adaptable gain ($g_1$) such that the energy of the driving signal (d) is minimized, thereby reducing the kinetic energy of ambient sound and vibration induced inside the padding (170).

7. An apparatus according to claim 3, wherein the driving means (150) is arranged to process the first feedback signal ($f_1$) by a first compensation filter ($H_1$) that is arranged to model an inverse of a first transfer function from the driving signal (d) to the first feedback signal ($f_1$); and process the second feedback signal by a second compensation filter ($H_2$) that is arranged to model an inverse a second transfer function from the driving signal (d) to the second feedback signal ($f_2$).

8. An apparatus according to claim 7, further comprising an adaptation means (152) arranged to carry out a filter calibration procedure to determine said first and second transfer functions ($H_1$, $H_2$), the filter calibration procedure comprising providing a predefined calibration signal as the driving signal (d) as input to the sound and vibration generation means (110) to generate corresponding first and second feedback signals ($f_1$, $f_2$), and deriving first and second sets of filter coefficients that, respectively, estimate the first and second transfer functions.

9. An apparatus according to claim 8, wherein said calibration signal is a noise signal that exhibits one or more of the following:

predefined spectral characteristics, predefined signal level.

10. An apparatus according to claim 8, wherein the adaptation means (152) is arranged to carry out the filter calibration procedure in conditions where the feedback information (f) indicates energy of ambient sound and vibration that is below a predefined threshold.

11. An apparatus according to claim 2, wherein the driving means (150) is arranged to derive a first cancellation signal by multiplying the first feedback signal ($f_1$) by a first adaptable gain value ($g_1$);

derive a second cancellation signal by multiplying the second feedback signal ($f_2$) by a second adaptable gain value ($g_2$); and generate the driving signal (d) as a signal that includes a combination of the first and second cancellation signals.

12. An apparatus according to claim 4, further comprising an adaptation means (152) arranged to carry out one of the following:

derive respective values of the first and second adaptable gains ($g_1$, $g_2$) such that the energy of the driving signal (d) is minimized, thereby reducing both the kinetic energy and the potential energy of ambient sound and vibration induced inside the padding (170);

set the value of the first adaptable gain ($g_1$) to zero and derive the value of the second adaptable gain ($g_2$) such that the energy of the driving signal (d) is minimized, thereby reducing the potential energy of ambient sound and vibration induced inside the padding (170);

set the value of the second adaptable gain ($g_2$) to zero and derive the value of the first adaptable gain ($g_1$) such that the energy of the driving signal (d) is minimized, thereby reducing the kinetic energy of ambient sound and vibration induced inside the padding (170).

13. An apparatus according to claim 5, further comprising an adaptation means (152) arranged to carry out one of the following:

derive respective values of the first and second adaptable gains ($g_1$, $g_2$) such that the energy of the driving signal (d) is minimized, thereby reducing both the kinetic energy and the potential energy of ambient sound and vibration induced inside the padding (170);

set the value of the first adaptable gain ($g_1$) to zero and derive the value of the second adaptable gain ($g_2$) such that the energy of the driving signal (d) is minimized, thereby reducing the potential energy of ambient sound and vibration induced inside the padding (170);

set the value of the second adaptable gain ($g_2$) to zero and derive the value of the first adaptable gain ($g_1$) such that the energy of the driving signal (d) is minimized, thereby reducing the kinetic energy of ambient sound and vibration induced inside the padding (170).

14. An apparatus according to claim 11, further comprising an adaptation means (152) arranged to carry out one of the following:

derive respective values of the first and second adaptable gains ($g_1$, $g_2$) such that the energy of the driving signal (d) is minimized, thereby reducing both the kinetic energy and the potential energy of ambient sound and vibration induced inside the padding (170);

set the value of the first adaptable gain ($g_1$) to zero and derive the value of the second adaptable gain ($g_2$) such that the energy of the driving signal (d) is minimized, thereby reducing the potential energy of ambient sound and vibration induced inside the padding (170);

set the value of the second adaptable gain ($g_2$) to zero and derive the value of the first adaptable gain ($g_1$) such that the energy of the driving signal (d) is minimized, thereby reducing the kinetic energy of ambient sound and vibration induced inside the padding (170).

15. An apparatus according to claim 4, wherein the driving means (150) is arranged to process the first feedback signal ($f_1$) by a first compensation filter ($H_1$) that is arranged to model an inverse of a first transfer function from the driving signal (d) to the first feedback signal ($f_1$); and process the second feedback signal by a second compensation filter ($H_2$) that is arranged to model an inverse a second transfer function from the driving signal (d) to the second feedback signal ($f_2$).

16. An apparatus according to claim 5, wherein the driving means (150) is arranged to process the first feedback signal ($f_1$) by a first compensation filter ($H_1$) that is arranged to model an inverse of a first transfer function from the driving signal (d) to the first feedback signal ($f_1$); and process the second feedback signal by a second compensation filter ($H_2$) that is arranged to model an inverse a second transfer function from the driving signal (d) to the second feedback signal ($f_2$).

17. An apparatus according to claim 11, wherein the driving means (150) is arranged to process the first feedback signal ($f_1$) by a first compensation filter ($H_1$) that is arranged to model an inverse of a first transfer function from the driving signal (d) to the first feedback signal ($f_1$); and process the second feedback signal by a second compensation filter ($H_2$) that is arranged to model an inverse a second transfer function from the driving signal (d) to the second feedback signal ($f_2$).

18. An apparatus according to claim 9, wherein the adaptation means (152) is arranged to carry out the filter calibration procedure in conditions where the feedback information (f) indicates energy of ambient sound and vibration that is below a predefined threshold.

* * * * *